US006336433B1

(12) United States Patent
Anton et al.

(10) Patent No.: US 6,336,433 B1
(45) Date of Patent: Jan. 8, 2002

(54) APPARATUS FOR ADJUSTING THE RELATIVE ANGLE OF A CAM SHAFT

(75) Inventors: Huber Anton, Munich; Speier Wolfgang, Stuttgart, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/719,584

(22) PCT Filed: Apr. 14, 1999

(86) PCT No.: PCT/EP00/01252

§ 371 Date: Feb. 11, 2001

§ 102(e) Date: Feb. 11, 2001

(87) PCT Pub. No.: WO00/61920

PCT Pub. Date: Oct. 19, 2000

(30) Foreign Application Priority Data

Feb. 16, 2000 (DE) ..... 199 16 675

(51) Int. Cl.[7] ..... F01L 1/344

(52) U.S. Cl. ..... 123/90.17; 74/568 R; 464/2; 464/160

(58) Field of Search ..... 123/90.15, 90.17, 123/90.31; 74/568 R; 464/1, 2, 160

(56) References Cited

U.S. PATENT DOCUMENTS

| | | | | | |
|---|---|---|---|---|---|
| 5,056,477 | A | | 10/1991 | Linder et al. | 123/90.17 |
| 5,870,983 | A | | 2/1999 | Sato et al. | 123/90.17 |
| 5,924,395 | A | * | 7/1999 | Moriya et al. | 123/90.15 |
| 6,039,016 | A | * | 3/2000 | Noguchi | 123/90.17 |
| 6,053,138 | A | * | 4/2000 | Trzmiel et al. | 123/90.17 |

FOREIGN PATENT DOCUMENTS

| | | |
|---|---|---|
| DE | 3922962 | 1/1991 |
| EP | 845584 | 6/1998 |
| JP | 60175738 | 9/1985 |

* cited by examiner

*Primary Examiner*—Weilun Lo
(74) *Attorney, Agent, or Firm*—Crowell & Moring LLP

(57) ABSTRACT

An apparatus adjusts the angle of a camshaft, in particular a camshaft provided for actuating exhaust valves, relative to the crankshaft driving the camshaft. An input element is driven by the crankshaft, an output element is adjusted relative to the input element and drives the camshaft, and a control device adjusts the input element relative to the output element. The output element is arranged at least approximately concentrically relative to the input element. At least one spring element for biasing the output element towards a basic position is arranged between the input element and the output element.

8 Claims, 1 Drawing Sheet

APPARATUS FOR ADJUSTING THE RELATIVE ANGLE OF A CAM SHAFT

BACKGROUND AND SUMMARY OF THE INVENTION

This application claims the priority of German Application 19916675.7, filed Apr. 14, 1999, the disclosure of which is expressly incorporated by reference herein.

The present invention relates to an apparatus for adjusting the relative or phase angle of a camshaft.

DE 197 26 300 A1 discloses an apparatus in which the impeller and the housing wheel have arranged between them a spring element that holds the impeller in a basic position. As a result, the impeller cannot move even when there is no oil pressure applied, and it is ensured that noise will no longer occur when the internal combustion engine is started and that the desired valve timings will be set even for the exhaust valve.

In this known arrangement, the housing wheel and the impeller each have recesses in which the spring element is arranged in order to ensure a certain guidance for the latter. On one hand, however, the guidance provided for the spring element is inadequate owing to the shallowness of the recess and, on the other hand, it is extremely expensive in terms of manufacture to produce the recess in the housing wheel. If the depth of the recess were increased, which would be advantageous for the guidance of the spring element, these difficulties in terms of manufacture would be increased.

With regard to the general prior art as regards apparatuses for adjusting the relative angle of camshafts, attention is furthermore drawn to EP 0 821 138 A1, EP 0 801 212 A1, DE 39 07 077 C2, DE 41 08 111 A1, DE 44 02 586 A1, DE 196 30 403 A1 and DE 196 54 926 A1.

SUMMARY OF THE INVENTION

An object of the present invention is to provide an apparatus for adjusting the angle of a camshaft relative to the crankshaft driving the camshaft. The apparatus retains the advantages as regards the adoption of the basic position but, at the same time, can be produced in a simple manner and with little outlay on machinery.

According to the invention, this object is achieved by opening the pocket-like recess of each projection in the axial direction.

By virtue of the fact that, according to the invention, the pocket-like recess of the at least one projection is open in the axial direction, the housing wheel can be produced economically by sintering, rendering a large amount of finish machining work unnecessary. Moreover, the spring elements can also be installed easily in the cavity between the impeller and the housing wheel.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
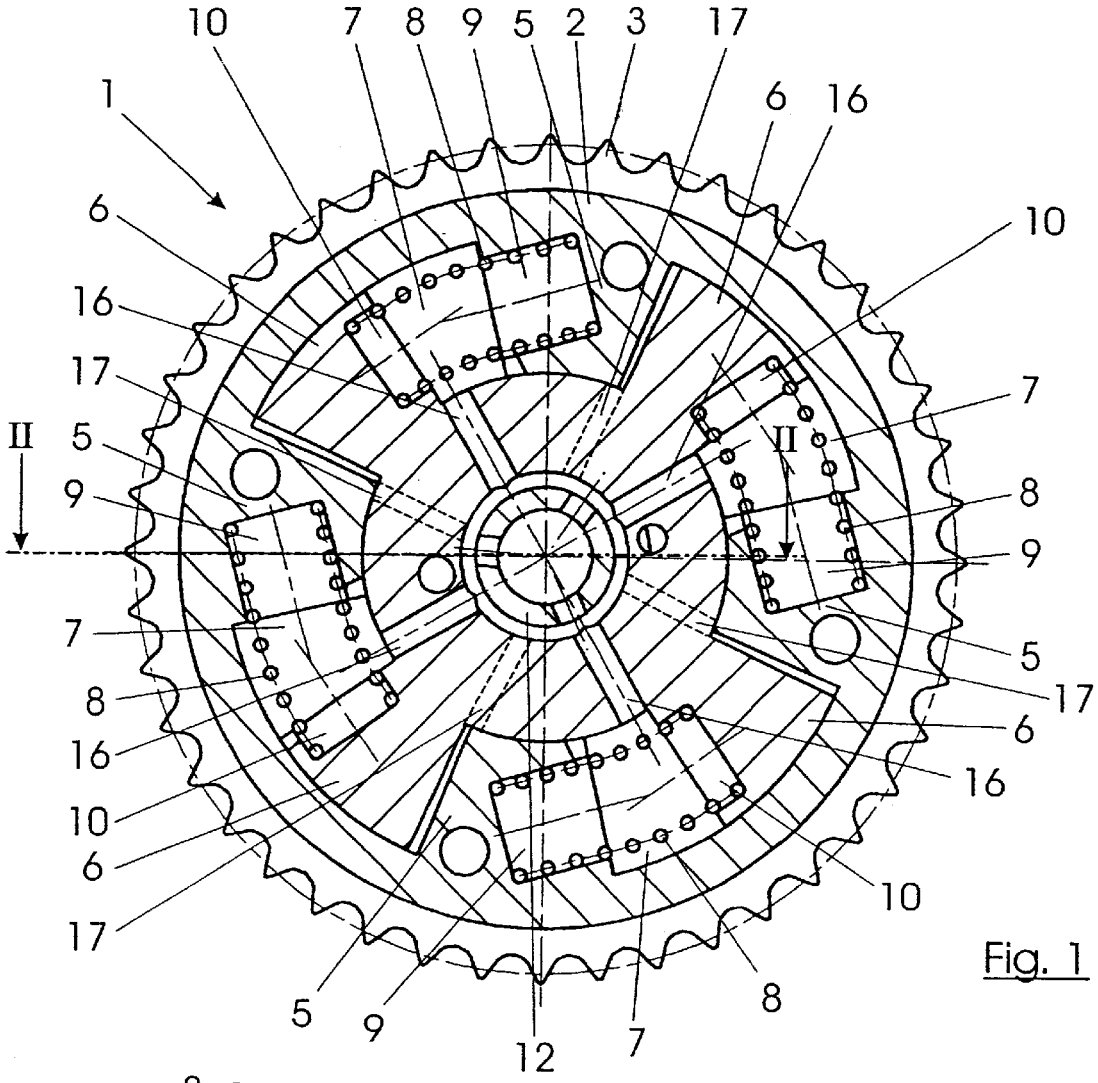
FIG. 1 is a plan cross-sectional view of an apparatus according to the invention in section along line I—I in FIG. 2.

FIG. 1 shows an apparatus 1 for adjusting the angle of a known camshaft (not shown) relative to a conventional crankshaft (likewise not shown) driving the latter. In the present case, the camshaft activates exhaust valves (likewise not shown) of an internal combustion engine operating in a known manner, but the apparatus 1 can also be used in the form described below with an inlet camshaft.

The apparatus 1 has an input element 2, which in this embodiment is a so-called housing wheel 2. For connection to the crankshaft, the housing wheel 2 is provided on its circumference with double toothing 3, of one-piece construction with the housing wheel 2, for a chain (not shown). Within the hollow housing wheel 2 there is an impeller 4, which forms the output element and is connected to the camshaft in a manner which is not shown but is known per se.

The housing wheel 2 has four inward-projecting projections 5, although a different number of projections 5 also being contemplated in other embodiments. The impeller 4 is provided with four outward-projecting vanes 6, each situated in recesses or cavities 7 in the housing wheel 2 that are formed between the individual projections 5. However, the vanes 6 do not fill the recesses 7 completely. The impeller 4 can thus perform a slight rotation within the housing wheel 2, this corresponding to the difference between the length of the recesses 7 and the length of the vanes 6, in each case in the circumferential direction.

To ensure that the vanes 6 rest against the projections 5, a spring element 8 is arranged between each of the projections 5 and vanes 6. The spring elements 8 press the vanes 6 against the edge of the projections 5 and thus hold the impeller 4 in its basic position, in which the camshaft effects "normal" valve timings. Owing to moments arising from friction, the camshaft and hence the impeller 4 constantly tend to move away from the projections 5, which would result in adjustment of the valve timing towards later opening of the exhaust valves. Particularly in the starting phase of the internal combustion engine, however, it is essential that the impeller 4 should be in its basic position.

Reliable guidance of the spring elements 8 is ensured by the fact that the projections 5 have pocket-like recesses 9, into which the respective spring elements 8 are inserted. The vanes 6 also have pocket-like recesses 10 to accommodate the spring elements 8. The spring elements 8, which in this case are configured as compression springs, are thus situated in the cavities 7 between the projections 5 and the vanes 6. In this case, the recesses 10 are shallower than the recesses 9.

To enable different restoring forces and restoring torques for the impeller 4 to be achieved, it is also contemplated (in a manner not shown) for a smaller or larger number of spring elements 8 to be provided. For this purpose, it is, on one hand, possible to insert no spring elements 8 into some of the existing cavities 7 or to provide a different number of projections 5 on the housing wheel 2 and the associated vanes 6 of the impeller 4. This represents a very simple and economical adaptation to different restoring torques of different internal combustion engines, on which the apparatus 1 can be employed. As an alternative, it is also possible to employ spring elements 8 with a different spring characteristic.

Figure 2:
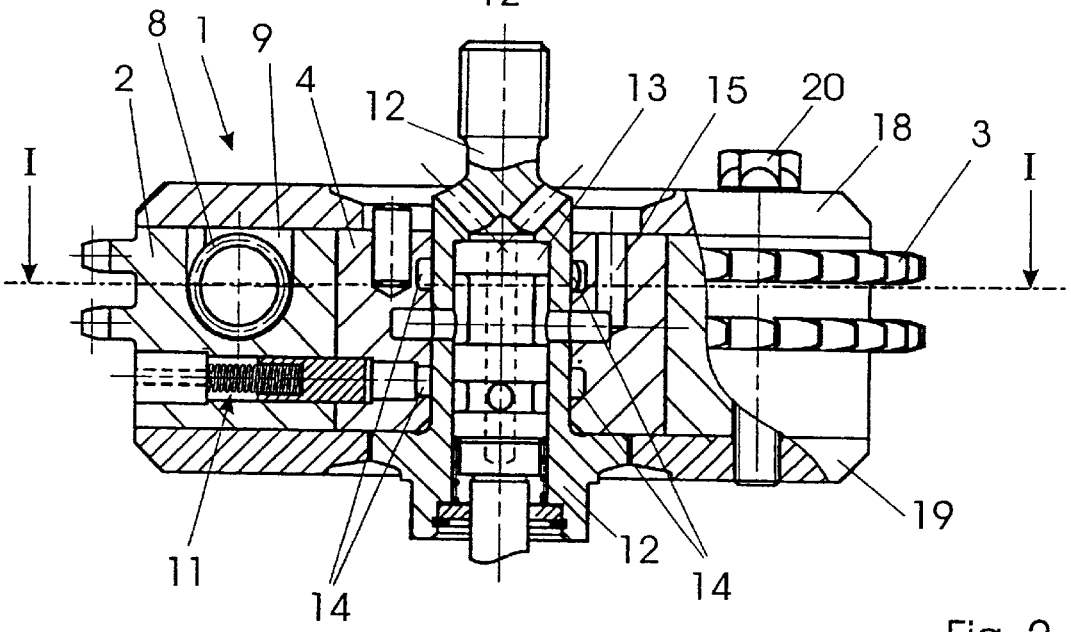
FIG. 2 is an elevational cross-sectional view of the apparatus according to the invention in section along line II—II in FIG. 1.

As is more clearly apparent in FIG. 2, the pocket-like recesses 9 in the projections 5 are open in the axial direction so as to allow the recesses 9 to be produced more easily and the spring elements 8 to be installed more easily. Low-cost sintering of the housing wheel 2 is namely made possible in this way. The pocket-like recesses 10 can also be open in the axial direction, opening up the possibility of likewise producing the impeller 4 by sintering. It is, of course, also possible to produce the recesses 10 in the impeller 4 by drilling. In this case, the recesses 10 would be closed.

FIG. 2 also reveals that a locking device 11 is provided on the housing wheel 2 and the impeller 4. This locking device allows the impeller 4 to be locked in its basic position. Since the locking device 11 is of a type known per se, it will not be described in further detail below.

A so-called central screw 12 is arranged, likewise in a known manner, within the impeller 4. Within the central screw 12 there is a control piston 13, likewise of known type. Together, the central screw 12 and the control piston 13 form a 4/2 proportional valve as a control device. Adjusting the control piston 13 axially in the central screw 12 exposes different annular passages 14 in the impeller 4. Oil entering the impeller 4 and the central screw 12 through inlet openings 15 brings about adjustment of the impeller 4 relative to the housing wheel 2 in a manner known per se. It is possible to use the oil of the internal combustion engine to operate the apparatus 1, i.e. the apparatus 1 can be included in the oil circuit of the internal combustion engine.

The exact manner of adjustment of the impeller 4 is, in turn, more clearly visible in FIG. 1. Thus, the impeller 4 is provided with holes 16 that open into the cavities 7 in the region between the vanes 6 and the projections 5. When oil is passed into the holes 16 from the annular passages 14, the oil pressure moves the impeller 4 in the direction of its basic position, i.e. that in which the vanes 6 rest against the projections 5. The impeller 4 can be locked in the basic position by the locking device 11, e.g. when the internal combustion engine is switched off. The locking device 11 can, in turn, be opened by oil pressure after the starting of the internal combustion engine. As described above, the impeller 4 is moved into the basic position by the spring elements 8 even when there is no oil pressure.

In the impeller 4 there are further holes 17, which are illustrated in broken lines and emerge from the impeller 4 directly behind the edge at which the vanes 6 rest against the projections 5. If oil is passed through the holes 17, the impeller 4 moves into another position against the force of the spring elements 8, thereby rotating the camshaft accordingly and setting a different valve timing.

The adjustment of the impeller 4 continues until the correct setting of the timing is detected by a sensor (not shown). The corresponding annular passages 14 and hence the holes 16 and 17 are then closed. Medium contained in the cavities 7 holds the impeller 4 in the set position. This is a case of continuous adjustment with an integrated 4/2-way proportional valve, as indicated above.

An embodiment without an integrated valve but with an external valve would also be possible as an alternative.

The apparatus 1 has covers 18, 19 on both sides in the axial direction and connected to one another by screws 20. In this arrangement, the covers 18, 19 delimit or define the space in which an oil pressure can be applied.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus for adjusting a camshaft angle relative to a crankshaft, comprising:

a driven input element;

a driving output element adjustable relative to the driven input element the output element being arranged at least approximately concentrically relative to the input element;

a control device for adjusting the input element relative to the output element; and at least one spring element for biasing the output element towards a basic position arranged between the input element and the output element, which output element is configured as an impeller with at least one vane and which output element is arranged within the input element, which input element is configured as a housing wheel; wherein the housing wheel has at least one inward-directed projection, against which the at least one vane of the impeller rests in a basic position of the impeller, a cavity, in which the at least one spring element is arranged, is formed between the at least one vane and the at least one projection, the at least one projection of the housing wheel has a pocket-like recess, the spring element is arranged in the pocket-like recess of the at least one projection which is open in an axial direction of the input and output elements.

2. Apparatus according to claim 1, wherein the at least one vane of the impeller has a pocket-like recess.

3. Apparatus according to claim 2, wherein the spring element is arranged in the pocket-like recess of the at least one vane.

4. Apparatus according to one of claim 1, wherein the spring element is a compression spring.

5. Apparatus according to claim 2, wherein the pocket-like recess of the at least one vane is open in the axial direction.

6. Apparatus according to claim 2, wherein a pocket-like recess of the at least one vane is closed in the axial direction.

7. Apparatus according to claim 1, wherein the impeller has a plurality of vanes configured to rest against a corresponding number of projections of the housing wheel in the basic position of the impeller with a predetermined number of spring elements being provided between the projections and the vanes depending on the restoring force required.

8. Method for making an apparatus for adjusting a camshaft angle comprising a hollow driven input element in the form of a housing wheel with at least one inwardly directed projection with a corresponding pocket-like recess which has an opening in an axial direction of the input element, comprising the steps of configuring a driving output element in the form of an impeller with at least one vane;

inserting in the axial direction of the input element a spring element into the opening of the corresponding pocket-like recess for biasing the at least one vane of the output element towards a basic impeller position; and arranging a control device to provide for selective adjustment of the input element relative to the output element.

* * * * *